US005096877A

United States Patent [19]

Kushi et al.

[11] Patent Number: 5,096,877

[45] Date of Patent: Mar. 17, 1992

[54] RECORDING MEDIUM FOR SUBLIMATION TYPE HEAT-SENSITIVE TRANSFER RECORDING PROCESS

[75] Inventors: Kenji Kushi; Tadayuki Fujiwara, both of Hiroshima; Hideyasu Ryoke, Tokyo; Kazuhiko Jufuku; Susumu Kondo, both of Hiroshima, all of Japan

[73] Assignee: Mitsubishi Rayon Co., Ltd., Tokyo, Japan

[21] Appl. No.: 551,956

[22] Filed: Jul. 12, 1990

[30] Foreign Application Priority Data

Jul. 19, 1989 [JP] Japan ..... 1-186305

[51] Int. Cl.[5] ..... B41M 5/35; B41M 5/26

[52] U.S. Cl. ..... 503/227; 8/471; 428/195; 428/480; 428/481; 428/482; 428/913; 428/914

[58] Field of Search ..... 8/471; 428/195, 480, 428/913, 914, 481, 482; 503/227

[56] References Cited

U.S. PATENT DOCUMENTS 4,720,480 1/1988 Ito et al. ..... 503/227
4,877,922 10/1989 Sasaki et al. ..... 528/272

FOREIGN PATENT DOCUMENTS 60-236794 11/1985 Japan ..... 503/227
62-198497 9/1987 Japan ..... 503/227

*Primary Examiner*—Bruce H. Hess
*Attorney, Agent, or Firm*—Oblon, Spivak, McClelland, Maier & Neustadt

[57] ABSTRACT

Recording medium for a sublimation type heat-sensitive transfer process, comprising a laminate paper comprising a paper and a white polyester film layer adhered on one surface of the paper, in which the white polyester film layer is provided with a dye receiving layer cured with active radiation.

6 Claims, 2 Drawing Sheets

RECORDING MEDIUM FOR SUBLIMATION TYPE HEAT-SENSITIVE TRANSFER RECORDING PROCESS

BACKGROUND OF THE INVENTION

1. Field of the Invention

The present invention relates to a recording medium for a sublimation type heat-sensitive transfer recording process.

2. Description of Related Arts

Sublimation type heat-sensitive transfer recording processes generally have various features such as quiet, the apparatus to be used is small in size and therefore cheap, maintenance thereof is easy and time required for output is short. In addition thereto, the use of sublimable disperse dyes enables high gradation recording by continuously changing the amount of thermal energy to be generated as well as a high density, high resolution recording. Therefore, this type of recording process is superior to other types of recording processes, particularly when it is intended to produce full-color hard copies, and these types of recording process are used widely for color printers and video printers.

Conventionally, the recording medium used in this type of recording process is a material composed of a paper or synthetic paper (mainly a polypropylene paper) on which is formed a recording layer as described in U.S. Pat. No. 4,778,782. However, if a polypropylene paper is used as a substrate, there arise various problems such curling after recording due to heat generated in the thermal head of the recording apparatus, recorded images are not lustrous, and the whiteness of image receiving sheets is low.

SUMMARY OF THE INVENTION

Intensive investigation has been made in order to overcome the above-mentioned defects of the prior arts such as low whiteness of image receiving sheets, the occurrence of curl in the image receiving sheets after recording, poor surface luster of recorded images, and an irregular surface, and as a result the present invention has been accomplished.

Therefore, the present invention provides a recording medium for a sublimation type heat-sensitive transfer process, comprising a laminate paper comprising a paper and a white polyester film layer bonded on one surface of the paper, wherein the white polyester film layer is provided with a dye receiving layer cured with active radiation (or actinic rays).

The recording medium for a sublimation type heat-sensitive transfer recording process according to the present invention has a high adhesion strength between the image receiving layer and the substrate, a high whiteness of the background and a good antistatic properties, gives images with irrefular surface, shows excellent luster after recording, and shows less curl after recording.

The above and other objects, effects, features and advantages of the present invention will become more apparent from the following description of embodiments thereof taken in conjunction with the accompanying drawings.

BRIEF DESCRIPTION OF THE ACCOMPANYING DRAWINGS

Figure 5:
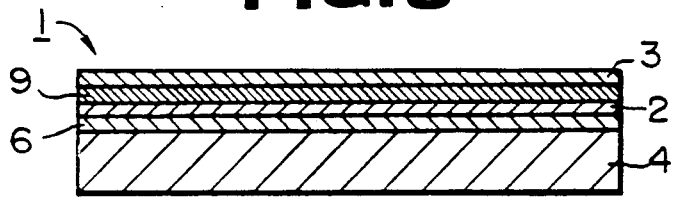
Figure 6:
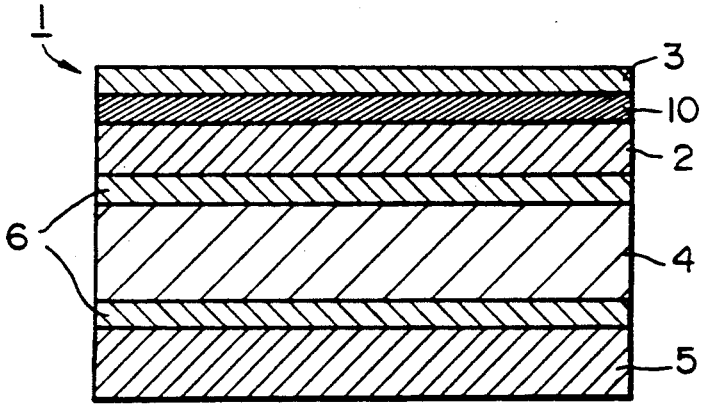

FIG. 5 is a cross-section of the recording medium for a sublimation type heat-sensitive transfer process according to the present invention which has a whiteness increasing layer; and FIG. 6 is a cross-section of the recording medium for a sublimation type heat-sensitive transfer process according to the present invention which has a composite-function layer having functions of the easily bondable layer and of the antistatic layer at the same time.

DESCRIPTION OF THE PREFERRED EMBODIMENTS

The present invention will now be described in detail.

In FIGS. 1 to 6, reference numeral 1 denotes a recording medium for a sublimation type heat-sensitive transfer recording process, 2 is a white polyester film, 3 is a dye receiving layer, 4 is a paper, 5 is a synthetic protective film or synthetic paper, 6 is an adhesive layer, 7 is an easily-bondable layer, 8 is an antistatic layer, 9 is a whiteness increasing layer, and 10 is an easily-bondable antistatic layer.

Figure 1:
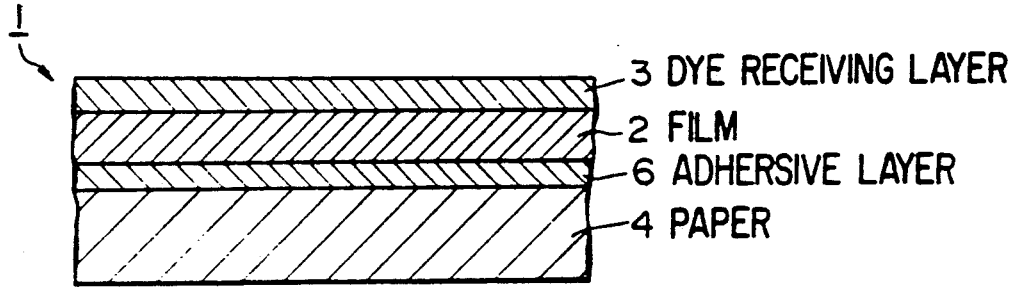
FIG. 1 is the cross-section of a recording medium for a sublimation type heat-sensitive transfer process according to the present invention, showing its basic construction.
Figure 2:
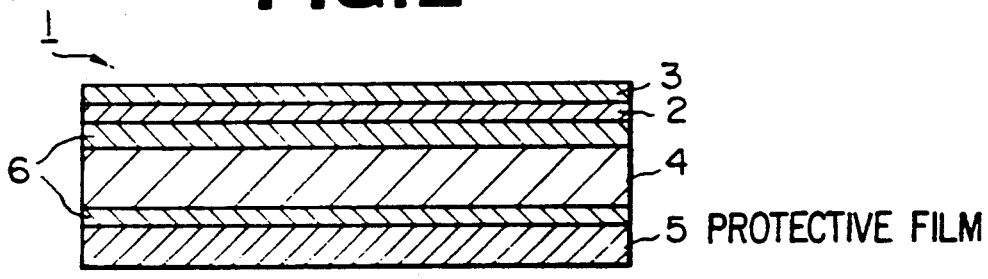
FIG. 2 is a cross-section of the recording medium for a sublimation type heat-sensitive transfer process according to the present invention which has a protective film or synthetic paper on the backside surface thereof.
Figure 3:
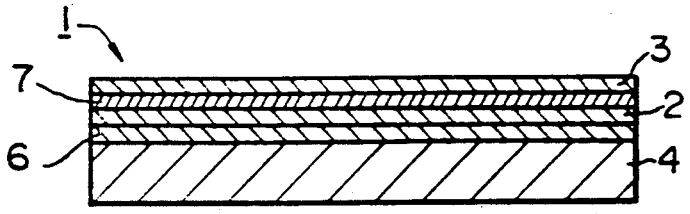
FIG. 3 is a cross-section of the recording medium for a sublimation type heat-sensitive transfer process according to the present invention which has an easily-bondable layer.
Figure 4:
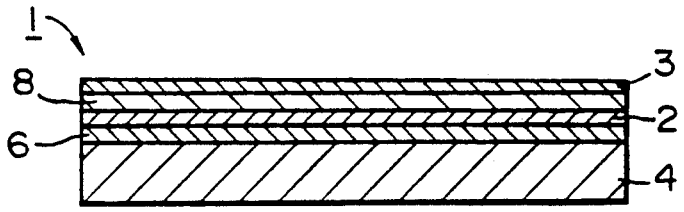
FIG. 4 is a cross-section of the recording medium for a sublimation type heat-sensitive transfer process according to the present invention which has an antistatic layer.

FIG. 1 is a schematic cross-sectional view of the recording medium of the present invention. In FIG. 1, the white polyester film 2 is bonded to the paper 4 through the adhesive layer 6. In FIG. 2, the synthetic paper or a protective film 5 is bonded to the paper 4 through the adhesive layer 6. The dye receiving layer 3 is provided on one surface of the white polyester film 2. It is preferred to provide the easily-bondable layer 7 on the white polyester film 2, more particularly between the white polyester film 2 and the dye receiving layer 3, as shown in FIG. 3 so as to increase the adhesion strength of the dye receiving layer 3 to the white polyester film 2. On the other hand, in order to prevent the static charge of the recording medium 1, it is preferred to provide an antistatic layer 8 on the white polyester film 2, or between the white polyester film 2 and the dye-receiving layer 3, as shown in FIG. 4. It is also preferred to provide on the white polyester film 2 or between the white polyester white polyester film 2 and the dye-receiving layer 3 a whiteness-increasing layer 9 for increasing the whiteness of the recording medium 1 as shown in FIG. 5. Alternatively, a single layer may be provided between the white polyester film 2 and the dye-receiving layer 3 which has simultaneously two or more of the functions which the layers 7, 8 and 9 have. FIG. 6 shows an embodiment in which a composite-function layer 10 which has the functions of the easily-bondable layer and of the antistatic layer at the same time.

The layers 6, 7, 8 and 9 each may generally have a thickness in the range of from 0.01 to 10 μm. In view of the purpose of the present invention, it is sufficient and preferred that they have a thickness of from 0.02 to 0.45 μm.

The synthetic paper or protective film 5 provided on the backside of the recording medium 1 is intended to adjust the smooth feeding of the recording medium 1 while it is passing through a printer (not shown) and to prevent the formation of dust by the paper when the recording medium is traveling in the device. Therefore, any synthetic papers or protective films may be used as long as they fulfill these criteria. However, in view of the prevention of the occurrence of static charge during the passage of the recording medium 1 in the device, it is preferred to use a material which has a sufficient antistatic property. If desired, an antistatic agent may be coated on the synthetic paper or protective film 5.

The dye-receiving layer 3 is to be cured with active radiation and therefore it is generally adapted to have features that it has resistance to contact pressure and heat due to a thermal head and has a high luster retention property. According to the present invention, the use of the film improves the luster retention property to a greater extent after recording of the recording medium.

Specific examples of the paper 4 include art paper and coat paper and the thickness thereof is generally from 20 to 200 μm. In view of heat resistance, it is preferred that the paper 4 has a thickness as large as possible. On the other hand, in view of smoothness, it is preferred that the paper 4 is as smooth as possible. As for the adhesive which is used to form the adhesive layer 6, any type of adhesive may be used that are used for bonding papers or films. However, in view of ease of bonding and reducing cost, it is preferred to use adhesives which are conventionally used for dry laminates. In view of the quality of recorded images, the resin component used in the adhesive is preferably the one which has a relatively high rubber elasticity and the thickness of the adhesive layer 6 is preferably from 1 to 10 μm.

Af the definition of the white polyester film 2 as a fiml, reference is made to U.S. Pat. No. 4,318,950. Among various wite polyester films, white polyester films such as W-300 and W-900 produced by Diafoil, Melinex 339, Melinex 329 produced by ICI, Lumirror E20 and Lumirror E60 produced by Toray are more preferred in order to obtain improved heat resistance and surface smoothness. The most preferred are Melinex 339 and Melinex 329 taking into consideration image quality in addition to the above-described properties. Examples of the white polyester film which has a composite layer composed of the easily-bondable layer and antistatic layer include W400J and W900J produced by Diafoil, which are preferred films. The thickness of the white polyester film 2 is preferably from 10 to 100 μm because if it is too small, the unevenness (depressions and protrusions) on the surface of the paper gives an unignorable influence on the quality of images after recording and on the other hand if it is too large, the total thickness of the image receiving sheet is undesirably large and the image receiving sheet is too heavy.

The composition which can be used for preparing the easily-bondable layer 7 may be urethane type polymers, rubber type polymers, acrylic type polymers and the like.

The composition which can be used for preparing the antistatic layer 8 includes anionic type antistatic agents such as aliphatic acid salts, higher alcohol sulfates, aliphatic alcohol phosphates, and aliphatic acid amide sulfonates; cationic type antistatic agents such as aliphatic amine salts, quaternary ammonium salts and pyridine derivatives; nonionic type anti-static agents such as polyoxyethylene alkyl ethers, polyoxy-ethylene alkylphenol ethers, polyoxyethylene alkyl esters, sorbitan alkyl esters, and polyoxyethylene sorbitan alkyl esters; amphoteric type antistatic agents such as alkylbetaines, and alkylimidazolines, alkylalanines; and electroconductive resins such as polyvinylbenzil type cations, polyacrylic acid type cations. Mixtures of one or more of the antistatic agents with a binder polymer may also be used.

The composition for preparing the composite layer 10 having both easily bonding property and antistatic property, which can be used as the white polyester film, is preferably a mixture of at least one antistatic agent selected from pyridine derivatives such as the following compounds:

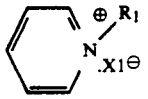

wherein $R_1$ is an alkyl group having preferably 12 to 18 carbon atoms, and $X_1$ is a halogen atom;

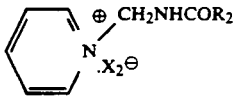

wherein $R_2$ is an alkyl group having preferably 6 to 10 carbon atoms, and $X_2$ is a halogen atom; and

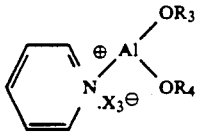

wherein $R_3$ and $R_4$, which may be the same or different, each is an alkyl group having preferably 6 to 10 carbon atoms, and $X_3$ is a halogen atom such as chlorine; with at least one easily bondable polymer selected from acrylic type polymers obtained by polymerization from methyl methacrylate and styrene, from ethyl acrylate and methyl methacrylate, and from methyl methacrylate, ethyl methacrylate and butyl methacrylate. Furthermore, in order to optimize other properties such as a slipping property of the white polyester film 2, one or more other compounds may be added to the composition in amounts in which the antistatic property and easily bonding property of the film may not be deteriorated.

The dye receiving layer 3 cured with active radiation is prepared by coating a composition comprising a sublimation type disperse dye-dyeable resin, a crosslinking agent which can be cured with active radiation and at least one releasing agent on a film substrate and then curing it with active radiation. It is preferred that the composition comprises the at least one releasing agent in an amount of from 0.01 to 12 parts by weight based on 100 parts by weight of the mixture composed of from 40 to 95% by weight of the polyester resin and from 60 to 5% by weight of the crosslinking agent which can be cured with active radiation. The dye receiving layer made of the above-described composition can easily be dyed with a sublimation type disperse dye, is highly stable and has a very excellent luster retaining property after recording. The thickness of the dye receiving layer is suitably not smaller than 1 μm because if it is below 1 μm, sensitivity of dyeing and stability of dyed images are insufficient.

As for the polyester resin, there can be used, for example, linear thermoplastic polyester resins obtained by polycondensation of a dicarboxylic acid and a diol and/or unsaturated polyester resins obtained by polycondensation of an unsaturated polybasic acid having a reactive double bond and a polyhydric alcohol. Of these, a linear thermoplastic polyester resin obtained by polycondensation of at least one dicarboxylic acid and at least one diol and having a molecular weight of from 2,000 to 40,000 and a degree of crystallinity of not higher than 1% is preferred in view of high solubility in organic solvents, ease of dyeing and high light resistance.

The amount of the polyester resin to be incorporated in the dye receiving layer 3 is preferably from 40 to 95% by weight based on the total weight of the polyester resin and the crosslinking agent. If the amount is less than 40% by weight, the color density of the dye receiving layer dyed with the sublimation type disperse dye is not high under low energy conditions. On the contrary, if the amount exceeds 95% by weight, the amount of the crosslinking agent is relatively poor, resulting in that the anti-blocking property of the dye receiving layer to the color sheet (transfer paper) coated with the sublimation type disperse dye is deteriorated and as the result blocking (sticking) tends to occur between the article coated with the sublimation type dye-easily dyeable resin composition and cured with active radiation and the color sheet upon heat transfer recording. More preferably, the amount of the polyester resin to be incorporated in the dye receiving layer is in the range of from 55 to 94% by weight.

Specific examples of the linear thermoplastic polyester resin obtained by polycondensation between at least one dicarboxylic acid and at least one diol include a polyester resin obtained from terephthalic acid, isophthalic acid, ethylene glycol and neopentyl glycol; a polyester resin obtained from terephthalic acid, isophthalic acid, ethylene glycol and a bisphenol A/ethylene oxide adduct; a polyester resin obtained from terephthalic acid, isophthalic acid, ethylene glycol and 1,6-hexanediol; a polyester resin obtained from terephthalic acid, isophthalic acid, sebacic acid, ethylene glycol and neopentyl glycol; a polyester resin obtained from terephthalic acid, sebacic acid, ethylene glycol and neopentyl glycol; a polyester resin obtained from terephthalic acid, isophthalic acid, adipic acid, ethylene glycol and neopentyl glycol. These polyester resins may be used in the form of mixtures of two or more thereof. In order to improve the stability against light, heat, water or others, preferably two or more of these polyester resins are used in combination. For example, when two polyesters A and B are used, preferably the A/B weight ratio is from 20/80 to 80/20.

It will be obvious that instead of terephthalic acid or isophthalic acid, an ester thereof, such as dimethyl terephthalate or dimethyl isophthalate, can be used as the starting material for the polycondensation.

Specific examples of the unsaturated polyester resin obtained by polycondensation between an unsaturated polybasic acid having a reactive double bond and a polyhydric alcohol include a polyester resin obtained from maleic anhydride, phthalic anhydride and propylene glycol, a polyester resin obtained from maleic anhydride, isophthalic acid and propylene glycol, a polyester resin obtained from maleic acid, fumaric acid, isophthalic acid and 1,3-butane diol, a polyester resin obtained from maleic acid, isophthalic acid and neopentyl glycol, and a polyester resin obtained from maleic anhydride, tetrahydrophthalic anhydride and dipropylene glycol.

The crosslinking agent is necessary for curing the resin composition which can be used in the recording medium of the present invention with active radiation and imparting a sticking resistance to the cured resin composition. The amount of the crosslinking agent to be incorporated is 5 to 60% by weight, preferably 5 to 45% by weight, based on the total amount of the polyester resin and the crosslinking agent. If the amount of the crosslinking agent is smaller than 6% by weight, sticking is readily caused. On the other hand, if the amount of the crosslinking agent is above 60% by weight, the sticking resistance is satisfactory but the proportion of the polyester resin is reduced and a sufficient color density cannot be obtained.

In view of the curability of the composition by the crosslinking agent and the sticking resistance of the composition, it is preferred that the crosslinking agent comprise at least one polyfunctional monomer. If ultraviolet rays that can be easily handled are used as the active radiation, the crosslinking agent is, preferably, a monomer which has acryloyloxy or methacryloyloxy groups as the polymerizable group.

Examples of the monomer having an acryloyloxy or methacryloyloxy group include monomers or oligomers of the polyether acrylate or polyether methacrylate type [hereinafter, "acrylate or methacrylate" will be referred to as "(meth)acrylate" for brevity], the polyester (meth)acrylate type, the polyol (meth)acrylate type, the epoxy (meth)acrylate type, the amide-urethane (meth)acrylate type, the urethane (meth)acrylate type, the spiroacetal (meth)acrylate type and the polybutadiene (meth)acrylate type.

Specific examples of the monomer or oligomer include polyether (meth)acrylates such as those synthesized from 1,2,6-hexanetriol, propylene oxide and acrylic acid, those synthesized from trimethylolpropane, propylene oxide and acrylic acid; polyester (meth)acrylates such as those synthesized from adipic acid, 1,6-hexanediol and acrylic acid and those synthesized from succinic acid, trimethylolethane and acrylic acid; (meth)acrylates or polyol (meth)acrylates such as triethylene glycol diacrylate, hexapropylene glycol diacrylate, neopentyl glycol diacrylate, 1.4-butanediol dimethacrylate, 2-ethyl hexyl acrylate, tetrahydrofurfuryl acrylate, 2-hydroxyethyl methacrylate, ethylcarbitol acrylate, trimethylolpropane triacrylate, pentaerythritol tetraacrylate, dipentaerythritol tetraacrylate, dipentaerythritol pentaacrylate, 2,2-bis(4-acryloyloxydiethoxyphenyl)propane, and 2,2-bis(4-acryloyloxypropoxyphenyl)propane; epoxy (meth)acrylates such as those synthesized from diglycidyl-etherified bisphenol A and acrylic acid, those synthesized from diglycidyl-etherified polybisphenol A and acrylic acid, and those synthesized from triglycidyl-etherified glycerol and acrylic acid; amide-urethane (meth)acrylates such as those synthesized from γ-butyrolactone, N-methylethanolamine, bis(4-isocyanatocyclohexyl)methane and 2-hydroxyethyl acrylate, and those synthesized form γ-butyrolactone, N-methylethanolamine, 2,6-tolylenediisocyanate, tetraethylene glycol and 2-hydroxyethyl acrylate; urethane acrylates such as 2,6-tolylenediisocyanate diacrylate, isophorone diisocyanate diacrylate, and hexamethylenediisocyanate diacrylate; spiroacetal acrylates such as those synthesized from diallylidene pentaerythritol and 2-hydroxyethyl acrylate; and acrylated polybutadienes such as those synthesized from epoxidized butadiene and 2-hydroxyethyl acrylate. These monomers and oligomers may be used singly or in the form of mixtures of two or more thereof.

Of the above-described monomers and oligomers, compounds represented by the following general formulae (I), (II) and (III) are especially preferred as the crosslinking agent because they have an excellent quick-drying property in air when ultraviolet rays are used as the active radiation.

(a) Compounds represented by the following general formula (I):

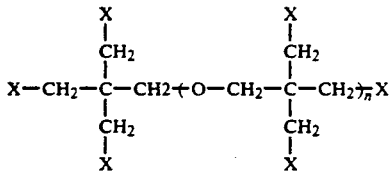

(I)

wherein n is an integer of from 1 to 4, at least three of the groups X are groups represented by the general formula $CH_2{=}CH{-}COO{-}R_8{-}$ (in which $R_8$ represents an alkylene group having 1 to 8 carbon atoms or a polyoxyalkylene group having an alkylene group having 1 to 8 carbon atoms or a polyoxyalkylene group having an alkylene group having 1 to 8 carbon atoms) or the formula $CH_2{=}CH{-}COO{-}$, and the remaining groups X are selected from an alkyl group having 1 to 8 carbon atoms, a hydroxyl group, an amino group, a group represented by the formula $-(OR_9)_m-H$ (in which $R_9$ represents an alkylene group having 1 to 8 carbon atoms and m is a positive integer) or a group represented by the formula $-(OR_9)_m-OH$ (in which $R^9$ and m have the same meanings as defined above.)

Specific examples of the compound of this type include dipentaerythritol tetraacrylate, dipentaerythritol pentaacrylate, dipentaerythritol hexaacrylate, tripentaerythritol pentaacrylate, tripentaerythritol hexaacrylate and tripentaerythritol heptaacrylate.

(b) Polybisphenol A polyacrylates represented by the following general formula (II):

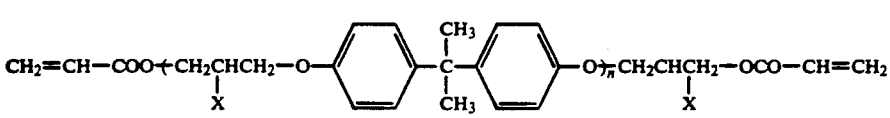

(II)

wherein n is a positive integer of from 1 to 10 and X is optionally —OH or $-OCOCH{=}CH_2$. Specific examples of the compound of this type include diglycidyl-etherified bisphenol A diacrylate and a diacrylate of Epikote #1001 (n=3, supplied by Shell Chemicals).

(c) Compounds represented by the following general formula (III):

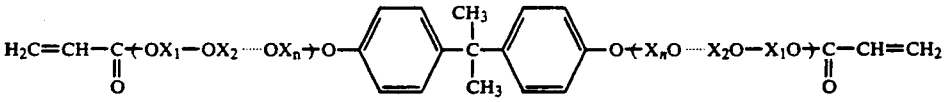

(III)

wherein $X_1$, $X_2$, through $X_n$, which may be the same or different, each represent an alkylene group having up to 6 carbon atoms, in which one hydrogen atom may be substituted by a hydroxyl group, and n is 0 or an integer of from 1 to 5.

Specific examples of the compound of this type include 2,2-bis(4-acryloyloxydiethoxyphenyl)propane, 2,2-bis(4-acryloyloxydiethoxyphenyl)propane and 2,2-bis(4-acryloyloxydipropoxyphenyl)propane.

In the present invention, it is necessary to incorporate a releasing agent in order to further improve blocking resistance (sticking resistance) between the recording medium and transfer paper (color sheet). As the releasing agent, there can be used at least one selected from a silicon type or silicon-containing surface active agent, a fluorine type or fluorine-containing surface active agent, and a graft polymer having a polyorganosiloxane moiety in the main chain or as a graft. They may be used singly or in the form of a mixture of two or more thereof. The releasing agent can be incorporated in an amount of from 0.01 to 12 parts by weight, preferably from 0.05 to 10 parts by weight, based on 100 parts by weight of the total of the polyester resin and the crosslinking agent.

Among the silicon-containing surface active agents, a polydimethylsiloxane/polyoxyalkylene block compound (which may be modified with another functional group) is effective, and a silicon-containing surface active agent of the block compound type in which the ratio of the group $CH^3-(SiO)_4-$ to the group —OR— (in which R represents an alkylene residue) is from 1/10 to 1/0.1, preferably from 1/5 to 1/0.2, is particularly preferred because the sticking resistance, the leveling property and the density of the color formed by dyeing are greatly improved when the composition is used as a coating material.

Specific examples of the above-described silicon-containing surface active agent include compounds represented by the following general formula (IV):

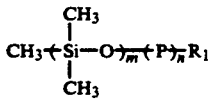

(IV)

wherein P represents $(CH_2CH_2O)_x(CH_2CH(CH_3)O)_y$, m and n each represent a positive integer of at least 1, x and y each represent 0 or an integer of at least 1, with the proviso that m, n, x and y satisfy the requirement defined by the following formula:

$$\frac{1}{10} \leqq \frac{2m+1}{nx+ny} \leqq 10$$

and $R_1$ represents a hydrogen atom, an alkyl group, an acyl group, an aryl group or an acetoxy group, and compounds represented by the following general formula (V):

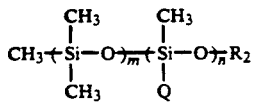

(V)

wherein Q represents

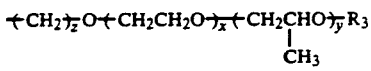

m and n each represent a positive integer of at least 1, x and y each represent 0 or an integer of at least 1, with the proviso that m, n, x and y satisfy the requirement defined by the following formula:

$$\frac{1}{10} \leqq \frac{2m+n+1}{nx+ny} \leqq 10$$

$R_2$ represents a group of the formula:

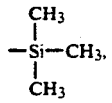

a hydrogen atom, an alkyl group, an acyl group or an aryl group; $R_3$ represents a hydrogen atom, an alkyl group, an aryl group or an acetoxy group. These compounds may be used singly or two or more of them may be used in the form of mixtures.

At least one substance selected from nonionic, anionic, cationic and amphoteric fluorine-containing surface active agents which are soluble to some extent in the mixture of the polyester resin and the crosslinking agent and show a blocking-preventing property can be used as the fluorine-containing surface active agent. Specific examples thereof include anionic surface agents such as fluoroalkoxypolyfluoroalkyl sulfates, fluorocarbon-sulfonic acid salts and fluorocarbon-carboxylic acid salts; cationic surface active agents such as N-fluoroalkylsulfonamide alkylamine quaternary ammonium salts, N-fluoroalkylsulfonamide alkylamine salts, N-fluoroalkylamide alkylamine quaternary ammonium salts, N-fluoroalkylamide alkylamine salts and N-fluoroalkylsulfonamide alkylhalomethyl ether quaternary ammonium salts; nonionic surface active agents such as fluorocarbon sulfonamides, fluorocarbon aminosulfonamides, fluorocarbon carboxysulfonamides, fluorocarbon hydroxysulfonamides, fluorocarbon sulfonamide/ethylene oxide adducts, fluorocarbon hydroxysulfonamide sulfates, fluorocarbon amino acid amides, fluorocarboxylic acid amides, fluorocarbon hydroxy-acid amides, fluorocarbon acid amide/ethylene oxide addition condensates, fluorocarbon hydroxy-acid amide sulfates, fluorocarbon hydroxy-acid amide phosphates, fluorocarbon sulfonic acids, fluoro-hydrocarbon carboxylic acids, fluorohydrocarbon alkyl esters, fluorohydrocarbon alkyl ethers, fluorohydrocarbon carboxyalkyl esters, fluorocarbon hydroxyamides, fluorohydrocarbon alkyl sulfates and fluoroalkyldiamines; and amphoteric surface active agents such as alkylamines having a betaine type fluorocarbon sulfonamide linkage and alkylamines having a betaine type fluorocarbon acid amide linkage. In order to improve the leveling property of the recording medium and prevent the blocking phenomenon, the use of nonionic surface active agents is preferred.

The graft polymer which has a polyorganosiloxane moiety in the main chain or as side chain in the molecule may be those graft polymers which comprise a homopolymer or copolymer obtained by vinyl polymerization, polycondensation, ring opening polymerization or the like as the main chain and a polyorganosiloxane as a side chain or graft. Specific examples of such graft polymer include a graft polymer which is obtained by attaching, by polymerization, at least one monomer selected from an alkyl (meth)acrylate, (meth)acrylic acid, a (meth)acrylic acid derivative having a functional group, vinyl acetate, vinyl chloride (meth)acrylonitrile, styrene and the like to a polysiloxane (macromonomer) to which a methacryloyloxy group, a vinyl group or a mercapto group is added at one terminal thereof; a graft polymer obtained by reacting a macromonomer comprised of a polysiloxane having two hydroxyl or carboxyl groups near its terminal with a dicarboxylic acid and a diol; a graft monomer obtained by reacting a macromonomer comprised of a polysiloxane having two hydroxyl or carboxyl groups near its terminal with a diepoxy compound or a diisocyanate compound.

Other graft polymers which can be used are graft polymers which have a polyorganosiloxane as the main chain and a homopolymer or copolymer obtained by vinyl polymerization, polycondensation, ring opening polymerization or the like as the side chain or chains. More specifically, there can be used a graft polymer having a polysiloxane as the main chain which is synthesized by condensing an organosilane with a silane having a vinyl polymerizable group, for example, 3-methacryloxypropyldimethoxymethylsilane, methylvinyldimethoxysilane, ethylvinyldiethoxysilane or the like to synthesize a polysiloxane monomer having a methacryloyloxy group in a side chain, and then polymerizing the monomer with at least one monomer selected from an alkyl (meth)acrylate, (meth)acrylic acid, a (meth)acrylic acid derivative having a functional group, vinyl acetate, vinyl chloride, (meth)acrylonitrile, styrene and the like; a graft polymer obtained by condensing an organosilane with diethoxy-3-glycidoxypropylmethylsilane to synthesize a polysiloxane having a glycidyl group in a side chain and then reacting it with (meth)acrylic acid to prepare a monomer having a (meth)acryloyloxy group, followed by polymerization of the monomer; a graft polymer obtained by condensing an organosilane with hydroxyethylmethyldimethoxysilane to synthesize a polysiloxane having a hydroxyl group in a side chain and polycondensing the diol with a dicarboxylic acid.

These graft polymers may be used singly or in the form of mixtures of two or more thereof.

Upon the synthesis of the polysiloxane which is used as the main chain or side chain of the graft polymer, a cyclic silane, particularly a cyclic dimethylpolysiloxane having 3 to 8 repeating units per molecule, as a starting compound can be polymerized using a silane compound having one alkoxy group per molecule, such as trimethylmethoxysilanesilane or trimethylethoxysilane as a molecular weight controlling agent as well as a silane having a functional group and a strong acid or a strong base as a catalyst at 70° to 150° C.

At least one graft polymer may be incorporated in the composition for the recording medium of the present invention in an amount of 0.01 to 12 parts by weight, preferably 0.05 to 10 parts by weight, per 100 parts by weight of the total amount of the polyester resin and the crosslinking agent. The incorporation of the graft polymer prevents the blocking of the recording medium to transfer paper (color sheet) completely and improves the dark fade resistance of dyed articles. The incorporation of the graft polymer in amounts outside the above-described range is undesirable because if the amount of the graft polymer incorporated is below 0.01 part by weight, the effect of preventing the blocking is insufficient and the dark fade resistance is not improved while cured articles cured with active radiation become semi-opaque and have a low color density when dyed with a sublimable dispersed dye if the amount of the graft polymer incorporated exceeds 12 parts by weight.

It is preferred that the molecular weight of the graft polymer having a polysiloxane moiety is 1,000 or more. Of the components which make up the graft polymer, the weight ratio of the polyorganosiloxane component to the homopolymer or copolymer which is other than the polyorganosiloxane and makes up the main chain or side chain of the graft polymer, i.e., (polyorganosiloxane component)/(homopolymer or copolymer component), is preferably from 95/5 to 10/90, and more preferably from 90/10 to 20/80. If this ratio exceeds 95/5, the dark fade resistance tends to be deteriorated. On the other hand, if it is below 10/90, the blocking resistance tends to be decreased and the dark fade resistance tends to be deteriorated. If the molecular weight of the graft polymer is below 1,000, there is a tendency that it is difficult to improve the dark fade resistance.

The resin composition which can be used for the production of the recording medium of the present invention can be directly coated as it is by roll coating, bar coating, blade coating or the like when a monomer which has a high polymer solubility and a low viscosity, such as tetrahydrofurfuryl acrylate, is used as a component of the crosslinking agent. However, in order to improve the adaptability to the coating operation, it is desirable to incorporate a solvent such as ethyl alcohol, methyl ethyl ketone, toluene, ethyl acetate or dimethylformamide so that the composition can be adjusted to have a viscosity suitable for coating. The adjustment of the viscosity makes it possible to carry out spray coating, curtain coating, flow coating, dip coating and the like with ease.

Fine particles of an inorganic substance such as silica, alumina, talc or titanium oxide which have a particle size of not larger than several micrometers (μm) may be incorporated in the composition of the present invention depending on the purpose or needs.

The resin composition for the production of the recording medium of the present invention which has been coated on a substrate can be cured with active radiation such as an electron beam and ultraviolet rays. In view of ease of control of rays, it is preferred to use ultraviolet rays as the active radiation. When ultraviolet ray is used as the active energy ray, a photopolymerization initiator is added to the composition in an amount of usually from 0.1 to 10 parts by weight per 100 parts by weight of the total amount of the polyester resin and the crosslinking agent in the composition. Specific examples of the photopolymerization initiator include carbonyl compounds such as benzoin, benzoin isobutyl ether, benzyl dimethyl ketal, ethyl phenyl glyoxylate, diethoxy-acetophenone, 1,1-dichloroacetophenone, 4'-isopropyl-2-hydroxy-2-methylpropiophenone, 1-hydroxycyclohexyl phenyl ketone, benzophenone, benzophenone/diethanolamine, 4,4'-bis(dimethylamino)-benzophenone, 2-methylthioxanthone, tert-butylanthraquinone and benzil; sulfur compounds such as tetramethylthiuram monosulfide and tetramethylthiuram disulfide; and peroxides such as benzoyl peroxide and di-tert-butyl peroxide. These compounds can be used singly or in the form of mixtures of two or more thereof. The above-described resin composition is coated on a substrate such as film and irradiated with active radiation to produce a recording medium.

In order to remove adverse influences due to fiber tailings and the like from paper and adjust the running property of the recording medium in printers, it is preferred that plastic films such as a polyester film, a polypropylene film, a nylon film, a vinyl chloride film and a polyethylene film or synthetic paper such as a polypropylene paper, YUPO FPG or SGU produced by Oji Yuka Co., Ltd. and TOYOPAL produced by Toyobo Co., Ltd. be laminated on the recording medium. These synthetic papers or protective films 5 and image receiving surface film 2 are bonded to paper with the adhesive layer 6. In this case, it is preferred to use a thicker adhesion layer because paper gives less influence.

The paper or film may be directly used or the paper or film may be subjected to a preliminary treatment such as washing, etching, corona discharge, irradiation with active radiation, dyeing or printing according to need, before actual use.

In the case where it is necessary to store dyed articles in the piled state for a long time, in order to prevent the migration of the dye, preferably the above-mentioned composition is coated only on one surface of the substrate. However, to effectively prevent the migration of the dye, it is especially preferred that a non-migration layer is formed on the surface opposite to the surface coated with the sublimable disperse dye-dyeable composition.

Examples of the composition for forming the non-migration layer include a coating material comprising 100 parts by weight of a monomer or oligomer mixture comprising the above-mentioned polyfunctional monomer and/or monofunctional monomer and, if necessary, 0.1 to 100 parts by weight of the above-mentioned photopolymerization initiator. In order to completely prevent the migration of the disperse dye, the average number of the photopolymerization groups in the monomer or oligomer mixture must be at least 1.5 per molecule. In connection with this coating material, adjustment of the viscosity by a solvent, coating on the substrate and curing can be performed in the same manner as described above with respect to the sublimable disperse dye-dyeable composition.

EXAMPLES

The present invention will now be described in detail with reference to the following examples. All "parts" in the examples and comparative examples are by weight.

FORMATION OF SUBSTRATE

Reference Example 1

A semi-opaque polyester film (W-300, produced by Diafoil, thickness: 38 μm) was laminated on one surface of a coat paper (thickness: 85 μm) and a white propylene paper (Toyopal SS, thickness: 50 μm) was laminated on the opposite surface using AD-577-1 and CAT-52 produced by Toyo Morton as adhesive in an amount of 5 g/m$^2$ on dry basis in the case where the semi-opaque polyester film was bonded to the coat paper or of 3 g/m$^2$ on dry basis in the case where the white polypropylene paper was bonded to the coat paper. The laminate papers were dried at 80° C. for about 30 seconds and then aged at 40° C. for 2 days.

REFERENCE EXAMPLE 2

A laminate paper was prepared in the same manner as in Reference Example 1 except that the semi-opaque polyester film (W-900 produced by Diafoil, thickness: 38 μm) was used in place of the one (W-300 produced by Diafoil, thickness: 38 μm).

REFERENCE EXAMPLE 3

A laminate paper was prepared in the same manner as in Reference Example 1 except that a white polyester film (Melinex 339 produced by ICI Japan, thickness: 38 μm) was used in place of the one (W-300 produced by Diafoil, thickness: 38 μm).

REFERENCE EXAMPLE 4

A semi-opaque polyester film W-300 produced by Diafoil (thickness: 188 μm) was used as the substrate.

REFERENCE EXAMPLE 5

A polypropylene film Yupo FPG produced by Oji Yuka (thickness: 200 μm) was used as the substrate.

REFERENCE EXAMPLE 6

A mixture of 60 parts by weight of a methyl methacrylate methyl methacrylate/styrene copolymer (BR-50 produced by Mitsubishi Rayon Co., Ltd.) and 40 parts by weight of a compound having the following formula:

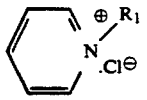

wherein $R_1$ is an alkyl group having 12 to 18 carbon atoms, was dissolved in a mixed solvent composed of methyl ethyl ketone/toluene (1:1) in a solid concentration of 10%. The solution thus obtained was coated on a white polyester film, i.e., the substrate obtained in Reference Example 1, using a bar coater and dried to form a uniform coating layer of a thickness of about 0.2 μm.

REFERENCE EXAMPLE 7

A dried uniform coating layer of a thickness of about 0.2 μm was formed on each of the white polyester films, i.e., the laminate papers obtained in Reference Examples 1 and 2, in the same manner as in Reference Example 6 except that a mixture of 50 parts by weight of a methyl methacrylate/ethyl acrylate copolymer (BR-64 produced by Mitsubishi Rayon Co., Ltd.), 45 parts by weight of a compound having the following formula:

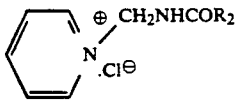

wherein $R_2$ is an alkyl group having 6 to 10 carbon atoms, and 5 parts by weight of sorbitan monooleate was used. The substrates obtained were defined as Reference Example 7-1 and Reference Example 7-2, respectively.

Formation of Image Receiving Layer

As for Examples 1 to 16 and Comparative Examples 1 and 2, coating compositions A to C having compositions shown in Table 1 were prepared and coated uniformly by dip coating on film substrates described in Reference Examples 1 to 7 in combinations described in Table 2 or 3. Then, the coated resins were irradiated in air with ultraviolet rays from a high pressure mercury lamp to form image receiving layers having film thicknesses of from 5 to 6 μm.

As for Comparative Examples 3 to 5, coating solution D was coated on film substrates obtained in Reference Examples 1, 4 and 5, respectively, using a wire bar in an amount of 6 g/m$^2$ on dry basis and dried to form image receiving layers on the substrates, followed by curing at 100° C. for 30 minutes using a hot air drier.

Images were recorded on the recording media thus obtained using a video printer (SCT-CP 100 produced by Mitsubishi Electric). SCT-CK 100 TS produced by Mitsubishi Electric) attached to the video printer was used as a transfer sheet.

Results of evaluations obtained are shown in Tables 2 and 3. The recording media obtained in Examples 1 to 7 and Comparative Examples 1 to 5 were examined for their surface resistivity and as the result they showed a surface resistivity of no lower than $10^{13}$ to $10^{15}$ Ω, and in addition, they showed slight peeling off of the image receiving layer upon peeling test using cross cut cellophane tapes.

TABLE 1

| Components of Resin Composition (parts) | Coating Solution A | Coating Solution B | Coating Solution C | Coating Solution D |
|---|---|---|---|---|
| Crosslinking Agent | | | | |
| 2P6A*1) | 3 | 3 | 3 | — |
| 2P5A*2) | 4 | 4 | 4 | — |
| 2P4A*3) | 3 | 3 | 3 | — |
| A-DEP*4) | 10 | 10 | 10 | — |
| Polyester Resin | | | | |
| Resin A*5) | 60 | 0 | 60 | 60 |
| Resin B*6) | 20 | 80 | 20 | 30 |
| Silicon-containing Surface active agent A*7) | 0.1 | — | 0.1 | |
| Amino-modified silicone (KF-393 produced by Shin-Etsu Kagaku) | — | — | — | 5 |
| Epoxy-modified silicone (X-22-343 produced by Shin-Etsu Kagaku) | — | — | — | 5 |
| Graft polymer GP-1*8) | — | 1 | 1 | — |
| Photopolymerization initiator 1-Hydroxycyclo- | 5 | 5 | 5 | — |

TABLE 1-continued

| | | | | |
|---|---|---|---|---|
| hexyl phenyl ketone | | | | |
| Solvent | | | | |
| Methyl ethyl ketone | 400 | 400 | 400 | 350 |
| Toluene | 100 | 100 | 100 | 350 |

Notes for Table 1

*1)2P6A: Dipentaerythritol hexaacrylate

*2)2P5A: Dipentaerythritol pentaacrylate

*3)2P4A: Dipentaerythritol tetraacrylate

*4)A-DEP: 2,2-bis(4-acryloyloxydiethoxyphenyl)propane

*5)Polyester resin A: Polyester resin obtained by polycondensation of terephthalic acid, isophthalic acid and sebacic acid with ethylene glycol and neopentyl glycol (molecular weight = 20,000 to 25,000, Tg = 10° C.)

*6)Polyester resin B: Polyester resin obtained by polycondensation of terephthalic acid, isophthalic acid and sebacic acid with ethylene glycol, neopentyl glycol and 1,4-butanediol (molecular weight = 1,5000 to 20,000, Tg = 45° C.)

*7)Silicon-containing surface active agent

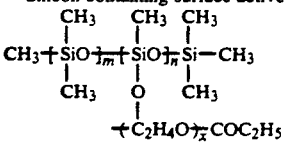

TABLE 1-continued $$\frac{2m + n + 1}{nx} = 1.3$$

*8)Synthetic Example 1: Graft polymer GP-1

| | |
|---|---|
| Polydimethylsiloxane having a methacryloyloxypropyl group at only one terminal thereof (molecular weight 5,000) | 100 g |
| Methyl methacrylate | 200 g |
| Benzoyl peroxide | 3 g |
| Toluene | 500 g |

The above composition was charged in a 3 liter-flask equipped with a stirrer and polymerized at 90° C. for 8 hours after air was purged with nitrogen. The resulting reaction mixture was added to a large amount of methanol to precipitate and recover a polymer.

The graft polymer thus obtained was found to be a polydimethylsiloxane/polymethyl methacrylate=33/67 having a molecular weight of about 80,000 and composed of polydimethylsiloxane as a side chain and polymethyl methacrylate as the main chain.

TABLE 2

| | Example 1 | Example 2 | Example 3 | Example 4 | Example 5 | Example 6 | Example 7 |
|---|---|---|---|---|---|---|---|
| Substrate Used | Prepared in Ref. Ex. 1 | Prepared in Ref. Ex. 1 | Prepared in Ref. Ex. 1 | Prepared in Ref. Ex. 2 | Prepared in Ref. Ex. 2 | Prepared in Ref. Ex. 3 | Prepared in Ref. Ex. 3 |
| Coating Solution for Forming Image Receiving Layer | Solution A | Solution B | Solution C | Solution A | Solution B | Solution A | Solution C |
| Properties Before Recording | | | | | | | |
| Whiteness*1) (Visual Observation) | ○ | ○ | ○ | ○ | ○ | ○ | ○ |
| Whiteness*2) | 97 | 97 | 97 | 98 | 98 | 96 | 96 |
| Properties After Recording | | | | | | | |
| Color Density (−log R)*6) | 1.21 | 1.21 | 1.20 | 1.23 | 1.22 | 1.21 | 1.21 |
| Luster After Recording*3) | 92 | 93 | 92 | 70 | 72 | 90 | 91 |
| Curl After Recording*4) | 5 | 5 | 5 | 6 | 5 | 5 | 6 |
| Coarse Touch of Image*5) | B | B | B | A | A | A | A |

| | Com. Ex. 1 | Com. Ex. 2 | Com. Ex. 3 | Com. Ex. 4 | Com. Ex. 5 |
|---|---|---|---|---|---|
| Substrate Used | Prepared in Ref. Ex. 4 | Prepared in Ref. Ex. 5 | Prepared in Ref. Ex. 1 | Prepared in Ref. Ex. 4 | Prepared in Ref. Ex. 5 |
| Coating Solution for Forming Image Receiving Layer | Solution A | Solution A | Solution D | Solution D | Solution D |
| Properties Before Recording | | | | | |
| Whiteness*1) (Visual Observation) | ○ | Δ | ○ | ○ | Δ |
| Whiteness*2) | 97 | 89 | 97 | 97 | 89 |
| Properties After Recording | | | | | |
| Color Density (−log R)*6) | 1.20 | 1.26 | 1.21 | 1.20 | 1.25 |
| Luster After Recording*3) | 95 | 39 | 39 | 40 | 37 |
| Curl After Recording*4) | 22 | 30 | 5 | 23 | 35 |
| Coarse Touch of Image*5) | C | B | B | C | B |

Notes for Table 2:

*1)Whiteness (Visual Observation): "○" indicates "high", and "Δ" indicates "moderate".

*2)Whiteness (%): According to JIS L-1015

*3)Luster after recording: Black image was recorded all over the surface; according to JIS P-8142.

*4)Curl after recording: After recording black image all over the surface, respective heights of four curled corners were measured and average value (mm) was calculated.

*5)Coarse touch of image: "A" indicates "no coarse touch of image at all", "B" indicates "almost no coarse touch of image", and "C" indicates "coarse touch of image".

*6)Color density (−log R): Recording was carried out using an NTT minifax (standard mode), and a reflection factor R at maximum absorption wavelength was measured by using a spectrophotometer. As for the transfer sheet, the above-described SCT-CK 100 TS cyan produced by Mitsubishi Electric was used.

TABLE 3

| | Example 8 | Example 9 | Example 10 | Example 11 | Example 12 |
|---|---|---|---|---|---|
| Substrate Used | Prepared in Ref. Ex. 6 | Prepared in Ref. Ex. 6 | Prepared in Ref. Ex. 6 | Prepared in Ref. Ex. 7-1 | Prepared in Ref. Ex. 7-1 |
| Coating Solution | Solution | Solution | Solution | Solution | Solution |

TABLE 3-continued

| | | | | | |
|---|---|---|---|---|---|
| for Forming Image Receiving Layer | A | B | C | A | B |
| Properties Before Recording | | | | | |
| Whiteness*1) (Visual Observation) | ○ | ○ | ○ | ○ | ○ |
| Whiteness*2) | 97 | 97 | 97 | 97 | 97 |
| Adhesiveness of Image Receiving Layer*7) | ○ | ○ | ○ | ○ | ○ |
| Surface Resistivity (Ω) | $10^9$ | $10^9$ | $10^9$ | $10^9$ | $10^9$ |
| Properties After Recording | | | | | |
| Color Density (−log R)*6) | 1.21 | 1.21 | 1.20 | 1.22 | 1.21 |
| Luster After Recording*3) | 92 | 93 | 92 | 92 | 93 |
| Curl After Recording*4) | 5 | 5 | 5 | 5 | 5 |
| Coarse Touch of Image*5) | A | A | A | A | A |

| | Example 13 | Example 14 | Example 15 | Example 16 |
|---|---|---|---|---|
| Substrate Used | Prepared in Ref. Ex. 7-1 | Prepared in Ref. Ex. 7-2 | Prepared in Ref. Ex. 7-2 | Prepared in Ref. Ex. 7-2 |
| Coating Solution for Forming Image Receiving Layer | Solution C | Solution A | Solution B | Solution C |
| Properties Before Recording | | | | |
| Whiteness*1) (Visual Observation) | ○ | ○ | ○ | ○ |
| Whiteness*2) | 97 | 98 | 98 | 98 |
| Adhesiveness of Image Receiving Layer*7) | ○ | ○ | ○ | ○ |
| Surface Resistivity (Ω) | $10^9$ | $10^{10}$ | $10^{10}$ | $10^{10}$ |
| Properties After Recording | | | | |
| Color Density (−log R)*6) | 1.21 | 1.23 | 1.22 | 1.21 |
| Luster After Recording*3) | 92 | 70 | 72 | 71 |
| Curl After Recording*4) | 5 | 6 | 5 | 5 |
| Coarse Touch of Image*5) | A | A | A | A |

Notes for Table 3:
*1)Whiteness (Visual Observation): "○" indicates "high", and "Δ" indicates "moderate".
*2)Whiteness (%): According to JIS L-1015
*3)Luster after recording: Black image was recorded all over the surface; according to JIS P-1842.
*4)Curl after recording: After recording black image all over the surface, respective heights of four curled corners were measured and average value (mm) was calculated.
*5)Coarse touch of image: "A" indicates "no coarse touch of image at all", "B" indicates "almost no coarse touch of image", and "C" indicates "coarse touch of image".
*6)Color density (−log R): Recording was carried out using an NTT minifax (standard mode), and a reflection factor R at maximum absorption wavelength was measured by using a spectrophotometer. As for the transfer sheet, the above-described SCT-CK 100 TS cyan produced by Mitsubishi Electric was used.
*7)Cross-cut peeling test with Scotch cellophane tape: "○" indicates "no peeling off occurred", "Δ" indicates "slightly peeling off occurred" and "X" indicates that "peeling off occurred considerably".

When cross-cut tests were performed on the recording media obtained in Examples 1 and 4, slight peeling off occurred. As compared with the recording media obtained in Examples 1, 2 and 3, those obtained in Examples 8, 9 and 10 showed improvement in coarse touch of image, and no coarse touch of image due to non-dyeing was observed in the latter recording media.

The invention has been described in detail with respect to embodiments, and it will now be apparent from the foregoing to those skilled in the art that changes and modifications may be made without departing from the invention in its broader aspects, and it is the invention, therefore, in the appended claims to cover all such changes and modifications as fall within the true spirit of the invention.

What is claimed is:

1. A recording medium for a sublimation type heat-sensitive transfer process, comprising a laminate paper comprising a paper and a white polyester film layer which is adhered to one surface of the paper, wherein the white polyester film layer is provided with a dye receiving layer cured with active radiation.

2. A recording medium as claimed in claim 1, wherein the dye receiving layer cured with active radiation is composed of a composition comprising a mixture composed of from approximately 40 to approximately 95% by weight of a polyester resin and from approximately 60 to approximately 5% by weight of a crosslinking agent which is curable with active radiation, with the sum of the polyester resin and the crosslinking agent being 100% by weight, to which is added a releasing agent, and wherein the proportion of the releasing agent to the mixture is from 0.01 to 12 parts by weight per 100 parts by weight of the mixture, the resulting composition being cured with active radiation.

3. A recording medium as claimed in claim 1, further comprising a synthetic paper or protective film bonded to a surface of the laminate paper which is opposite to the surface on which the white polyester film layer is provided.

4. A recording medium as claimed in claims 1 or 3, wherein an antistatic layer is formed on the surface of the laminate paper on which the white polyester film layer is provided.

5. A recording medium as claimed in claim 4, wherein the antistatic layer has an easily bondable property so that adhesion between the white polyester film layer and the dye receiving layer can be increased.

6. A recording medium as claimed in claim 5, wherein the antistatic layer is constructed of an antistatic agent composed of a pyridine derivative and a binder resin composed of an acrylic polymer.

* * * * *